United States Patent [19]

van Wesenbeeck

[11] Patent Number: 4,705,418

[45] Date of Patent: Nov. 10, 1987

[54] APPLICATOR DEVICE FOR PRECISION PAINTWORK

[76] Inventor: Cornelis M. van Wesenbeeck, 4, Kapelstraat, NL-4726 AM Heerle (Province of Brabant), Netherlands

[21] Appl. No.: 799,161

[22] Filed: Nov. 18, 1985

[30] Foreign Application Priority Data

Nov. 6, 1985 [NL] Netherlands ..... 8501971

[51] Int. Cl.[4] ..... A46B 11/00; A46B 17/00

[52] U.S. Cl. ..... 401/15; 15/166; 15/246; 15/248 R; 401/14; 401/193

[58] Field of Search ..... 15/246, 248 R, 166; 401/14, 15, 193

[56] References Cited

U.S. PATENT DOCUMENTS

| | | | |
|---|---|---|---|
| 558,245 | 4/1896 | Williams | 15/248 X |
| 832,966 | 10/1906 | Graf | 15/248 R |
| 2,534,589 | 12/1950 | Gebien | 401/15 |
| 2,609,558 | 9/1952 | Johnson | 401/15 |
| 2,610,344 | 9/1952 | Gaffer et al. | 15/166 |
| 2,712,667 | 7/1955 | Stearn et al. | 15/246 |
| 2,717,407 | 9/1955 | Hanhart | 15/246 |
| 2,807,041 | 9/1957 | Watro | 15/248 X |
| 2,820,237 | 1/1958 | Maslaney | 15/248 X |
| 3,401,418 | 9/1968 | Deck et al. | 15/166 |

FOREIGN PATENT DOCUMENTS

| | | | |
|---|---|---|---|
| 84554 | 12/1895 | Fed. Rep. of Germany | 401/15 |
| 29922 | of 1897 | United Kingdom | 15/166 |
| 651683 | 4/1951 | United Kingdom . | |

*Primary Examiner*—Steven A. Bratlie

*Attorney, Agent, or Firm*—Erwin S. Teltscher

[57] ABSTRACT

A paint applicator device for precision paintwork, comprising a platform (1) which bears a controllable case (17) clenching a brush implement (8), such that the protruding end of the brush can be pressed along the platform edge (2) in an adjustable way.

6 Claims, 7 Drawing Figures

APPLICATOR DEVICE FOR PRECISION PAINTWORK

The present invention relates to a brush applicator device for very accurate precision paintwork along skirting boards, windows, linths, panels and ornaments on furniture and house decoration. According to the state of the art for accurate painting along separating lines, e.g. of furniture, window-frames, glasspanes, etc., without getting across a reflected line, a sticking crape ribbon is being used, which is to be removed again after completion of the paintwork.

Especially for larger items but also for small-scale do-it-yourself tasks, this delimiting glueing is felt as an accessory tiresome activity which not only requires extreme accuracy and skill but which moreover increases the quantity of paint used in an uncontrollable way; for the paint which comes upon the crape ribbon is lost material.

Also during removal of the ribbon parts, the paint just applied can be torn away in part again.

Therefore a solution of the problem has been sought, which will enable a more accurate, efficient and easier mode of working.

There exist already applicator devices for the coating of objects with industrial lacquers, for example pressurized spraying nozzles, airless spray guns, as well as stencils and masks for covering surfaces with lacquer, where certain parts or forms are to be excluded or shall be painted with another color or with a colorless varnish.

Holders for paint brushes to prevent paint to drip off and to avoid the so-called running down on painted surfaces are known, such as described in British Patent Specification No. 651.683.

These are brush holders for large surfaces which are difficult to attain, and comprise an upright handle of a pistol grip type, upon which a platform extends forward and rearwards.

However these devices are not intended and cannot be used for an accurate application of linings along lintels, window frames, roof edges, plinths, glass panes, panels, commercial advertisement characters, furniture etc., and the like.

For such a purpose an applicator according to the present invention is very appropriate.

The applicator for creating ornamental linings in sharp delimitations and for designs upon objects to be painted as characterized according to the present invention in that it consists mainly of a mask platform plate (1) with a sloping edge (2) and a curved fixation end (3), upon which platform plate a tension spring (6), flexibly adjustable by means of an adjusting screw (4) with a nut (5), is mounted, which seizes a case (7) extending parallel with the mask platform in the rest position, said case clenching tightly a brush implement (8) and being provided with a push-button (9), while the step (10) of the brush is surrounded by a cylindrically shaped pressure spring (11), which is kept by a spring-keeping ring (12), with a clamping-screw (13).

According to an alternative embodiment, the stem (10) of the brush is provided with an axial supply pipe (14), through which the paint from a stock tank (15), which can be cut off and which is mounted upon said stem with injection cylinder and nipple, is fed gradually and regularly to the brush implement (8).

In a similar embodiment of the device according to the present invention the adjusting tension spring (6) is replaced by a resilient flat leafshaped spring (16), which is being held in the desired position by means of an adjusting ball (17) fitting into one of several holes at desired distances of a fastening lid (18).

Instead of a spring-keeping ring with clamping-screw a swivel (19) can be used for pressing the pressure spring (11), such that the length of the protruding end of the brush is adjusted at a distance according to measure.

The method of making borders, accurately delimited linings and painting planes with paint or lacquer upon separate surfaces or objects is characterized according to the invention, in that the end of the brush by dipping in the paint or by feeding from the tank, is provided with paint, the desired length of the protruding end of the brush implement is adjusted is the working position by shifting the spring-keeping ring (12) and securing the clamping-screw (13) or by turning the swivel (19) respectively, while the working position of the brush end at the platform edge is defined by means of the adjusting screw with the nut and the tension spring, or by the leaf-shaped spring (16) with its ball-fitting adjustment (17), that the brush is pressed along the platform edge with the pushbutton and the mask platform is moved along the desired line or linings. The invention is further explained by means of the enclosed drawings.

Figure 1:
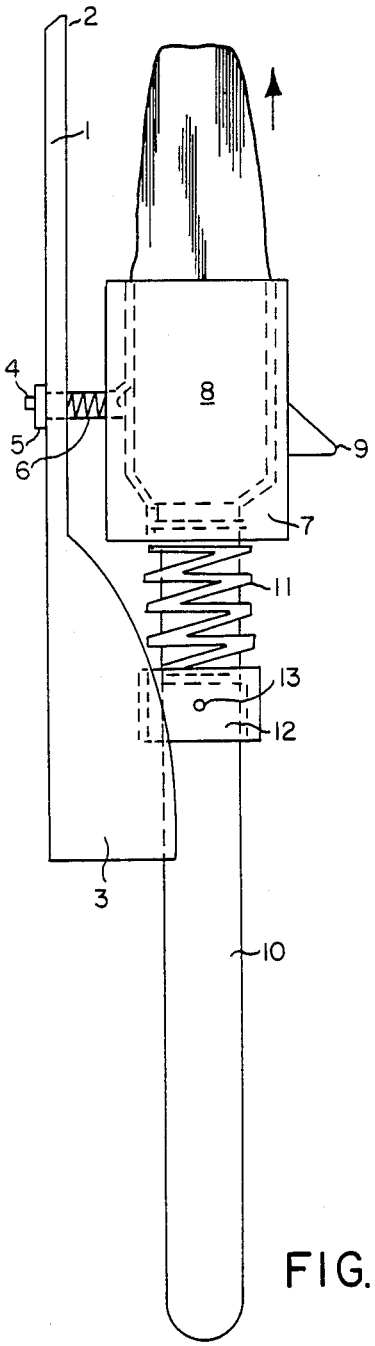
FIG. 1 is a side elevational view of the applicator according to the invention.
Figure 2:
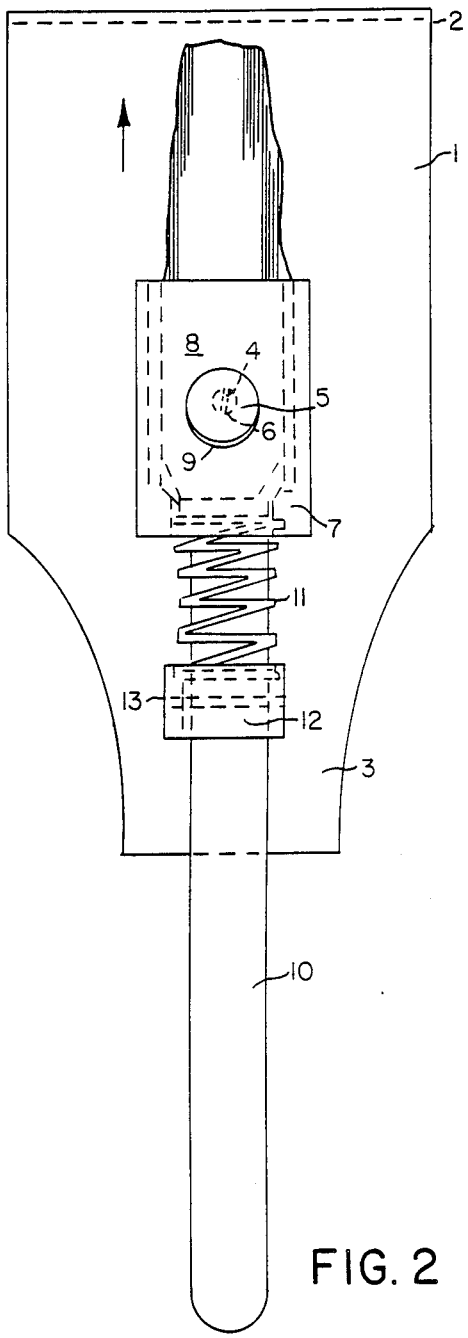
FIG. 2 is a top view of the applicator.
Figure 3A:
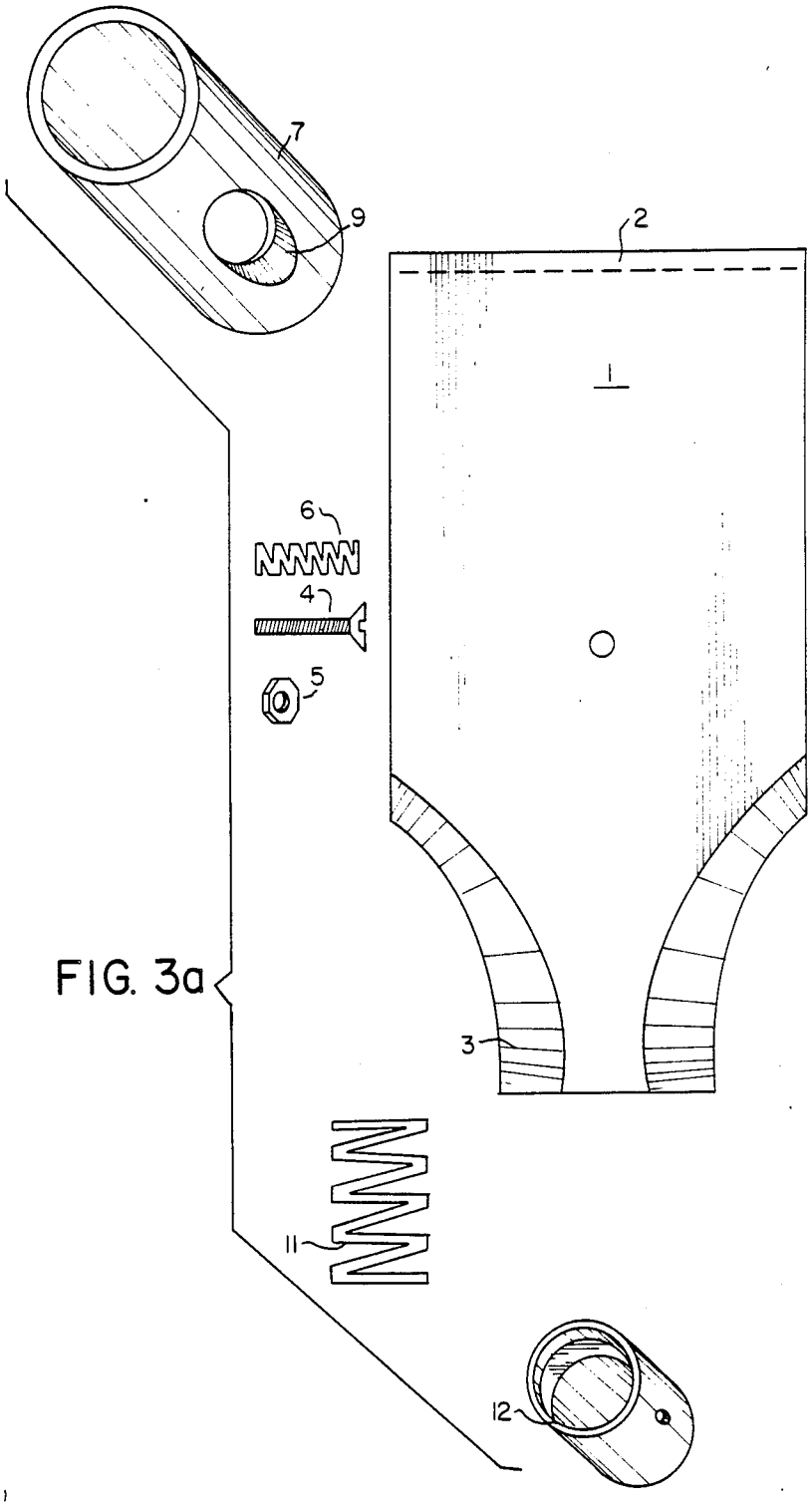

FIG. 3*a* is an exploded top view of the applicator, showing the structural parts separately.

Figure 3B:
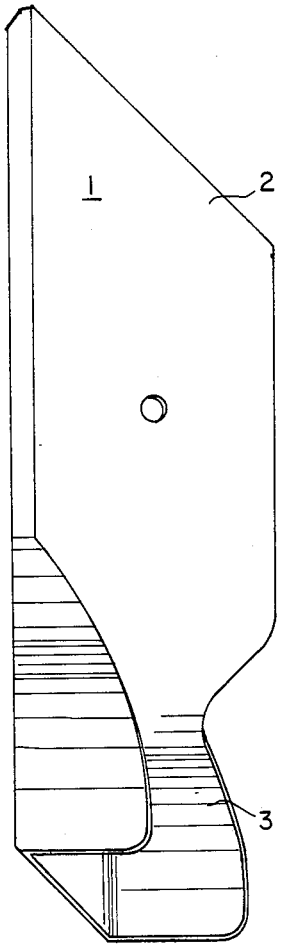
Figure 3C:
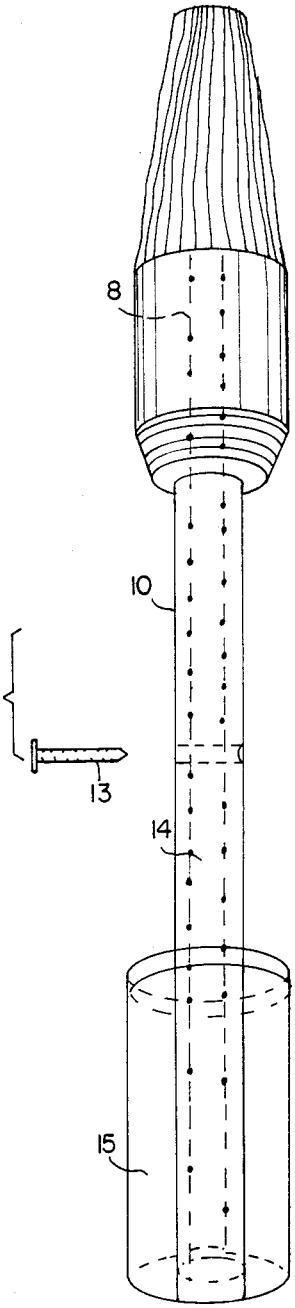

FIG. 3*b* is a perspective view of a mask platform of the applicator of FIG. 3*a*, and FIG. 3*c* is a perspective view of a brush with a stock tank mounted thereon.

Figure 4:
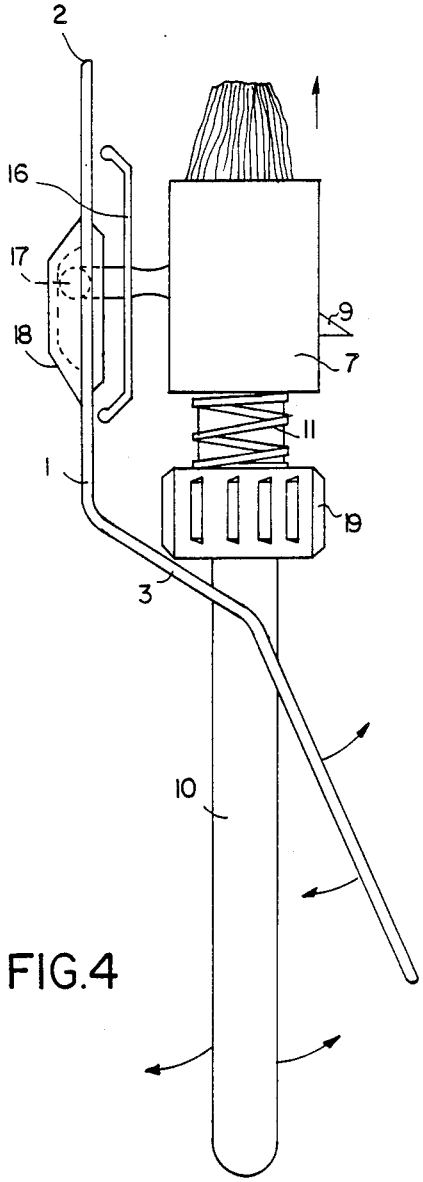
Figure 5:
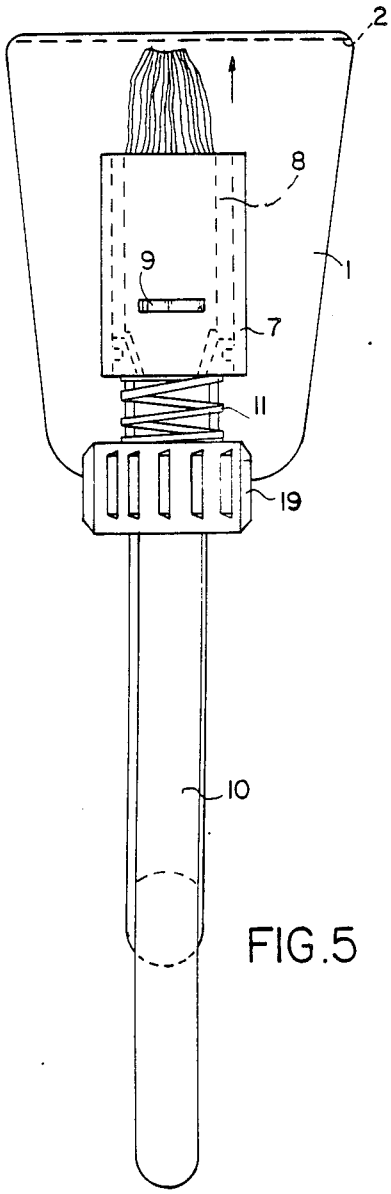

FIGS. 4 and 5 show an alternative similar embodiment of the applicator.

In the figures, (1) is the platform plate with the sloping edge (2), the fixation end (3), the adjusting screw (4) with the nut (5), and the tension spring (6), or the leaf-shaped spring (16) respectively. The case (7) serves for gathering up the brush implement (8) and it comprises a push-button (9).

Around the brush stem (10), the pressure spring (11) is positioned and the spring-keeping ring (12) can be fastened by the clamping-screw (13) or the spring (11) is kept by the swivel (19), around the stem (10), such that the spring attains the tension desired.

A further improvement of the system is attained by providing the brush with a supply pipe (14) and a stock tank (15).

The invention is not restricted to the reproduced examples.

The material of the platform plate and the fixation part can be metal, wood or a plastic or hard synthetic rubber which is solvent-resistant. The use of the applicator according to the invention gives the skilled man and the do-it-yourself customer the possibility to paint lines and precisely limited planes with more ease and with more accuracy. A good gauge standard can be obtained also along lengths of several meters.

For borders the thickness of the lines can be ascertained by the assortment of brushes, and instead of normal brushes for broad surfaces square brushes and for fine lines pencil brushes can be inserted into the case of the applicator.

Said case can be either cylindrically shaped externally or square or polygonal and can have different inner diameters, such that brush and pencil devices of divergent diameters can be put into practice. The entire article can be pulled out and cleaned easily.

What is claimed is:

1. An applicator for applying painted border lines and precisely limited lines and decorations upon surfaces and objects, comprising a brush implement having a stem portion and a brush portion mounted on the stem portion and including a multitude of bristles;

a flat mask platform having a sloping edge and an arched fixation end;

a confining sleeve which is displaceable on said brush portion of said implement between a rest position and a plurality of working positions and tightly embraces at least a section of said brush portion to keep said bristles thereof together while received in said sleeve and to expose another section of said brush portion, the magnitude of said exposed section depending on the extent of displacement of said sleeve out of said rest position, for use in applying paint, said sleeve including a push button for displacing said sleeve out of said rest position thereof;

means for resiliently urging said sleeve toward said rest position thereof relative to said brush implement; and means for mounting said mask platform on said sleeve for joint displacement therewith through an intermediary position in which said exposed section of said brush portion is substantially flush with said sloping edge of said platform to a fully extended position in which said exposed section extends beyond said sloping edge, and also for resilient movement with respect to said sleeve in a manner bringing said exposed section and said sloping edge closer together and farther apart.

2. The applicator according to claim 1, wherein said mounting means includes a setting screw and a nut which cooperate with one another to connect said platform to said sleeve for said movement upon turning said screw relative to said nut, and a helical tension spring extending between said platform and said sleeve.

3. The applicator according to claim 1, wherein said mounting means includes a fastening lid secured to said platform and provided with a plurality of holes, a pin secured to said sleeve, a ball carried by said pin and received in a selected one of said holes of said fastening lid, and a leaf spring engaging said platform and secured to said pin in such a manner as to urge said pin toward said fastening lid.

4. The applicator according to claim 1, wherein said brush implement includes a spring-keeping ring mounted on said stem portion for displacement longitudinally thereof and arrestable in any desired position; and wherein said urging means includes a helical spring extending between said confining sleeve and spring-keeping ring.

5. The applicator according to claim 1, wherein said brush implement includes a swivel mounted on said stem portion; and wherein said urging means includes a helical spring extending between said confining sleeve and said swivel.

6. The applicator according to claim 1, and further comprising a paint receptacle mounted on said stem portion and means for gradually supplying paint from said paint receptacle to said brush portion of said brush implement.

* * * * *